United States Patent [19]

Distasio

[11] Patent Number: 4,731,710

[45] Date of Patent: Mar. 15, 1988

[54] DECORATIVE LIGHTING TRACK SYSTEM

[76] Inventor: Joseph Distasio, 10 Edelweiss La., Voorhees, N.J. 08043

[21] Appl. No.: 44,293

[22] Filed: Apr. 30, 1987

[51] Int. Cl.[4] ..... F21S 1/02; F21S 1/14; F21S 3/02

[52] U.S. Cl. ..... 362/147; 362/250; 362/404

[58] Field of Search ..... 362/147, 404, 249, 250

[56] References Cited

U.S. PATENT DOCUMENTS

| | | | |
|---|---|---|---|
| 2,963,251 | 12/1960 | Fuss | 362/404 X |
| 4,130,858 | 12/1978 | Hayakawa | 362/404 X |
| 4,591,764 | 5/1986 | Nilssen | 362/404 X |

*Primary Examiner*—Lloyd L. King
*Attorney, Agent, or Firm*—Charles F. Duffield

[57] ABSTRACT

A track lighting system is disclosed for decoratively support and concealing an elongate standard transversely adjustable lighting track and associated track clamp and lighting fixture upon a flat surface such as a common wall or ceiling. A decorative flat panel member or planar member is positioned upon the wall or ceiling and the elongate standard lighting track positioned thereupon. Decorative trim or molding is provided around the opposed side walls and end walls of the planar member as well as around the side walls and end walls of the lighting track. A hollow boxlike track cover member having side walls and an end wall is positioned over the lighting track and associated molding and has cutouts in two of the opposed side walls complementary with the cross section of the lighting track and associated decorative molding. The end wall of the cover member provides concealment of the track member and provides a supporting wall for the bell of a lighting fixture such that, when the lighting fixture is secured in place upon the track clamp and the track clamp positioned within the lighting track, the lighting fixture and associated bell will secure the cover member in place against the planar member while providing for transverse adjustment along the lighting track as desired.

4 Claims, 8 Drawing Figures

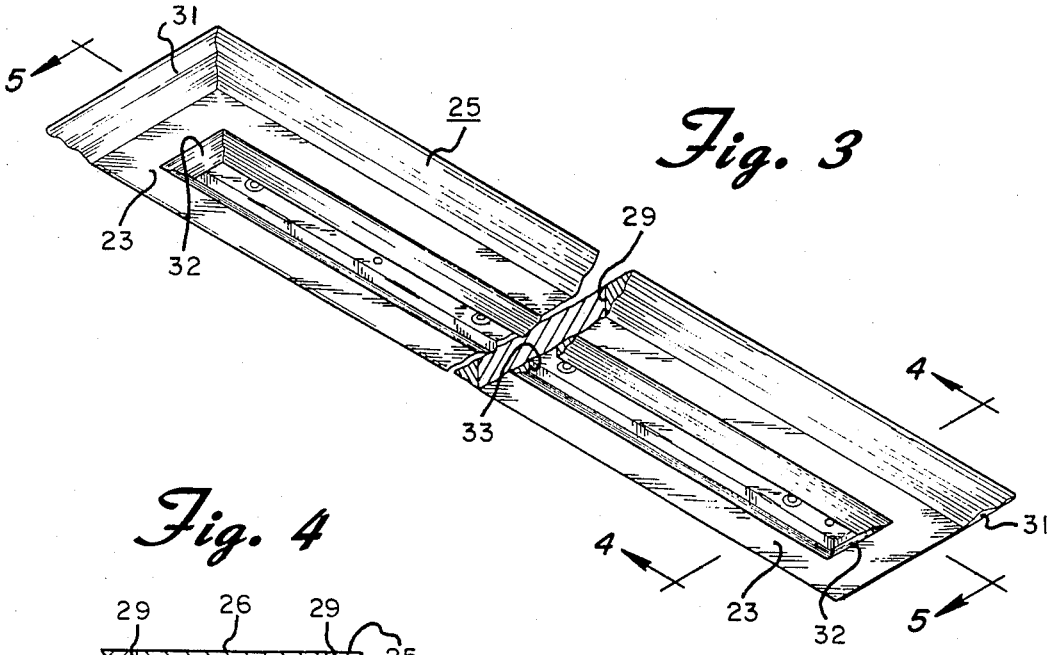
Fig. 3
Fig. 4
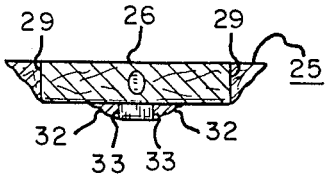
Fig. 5
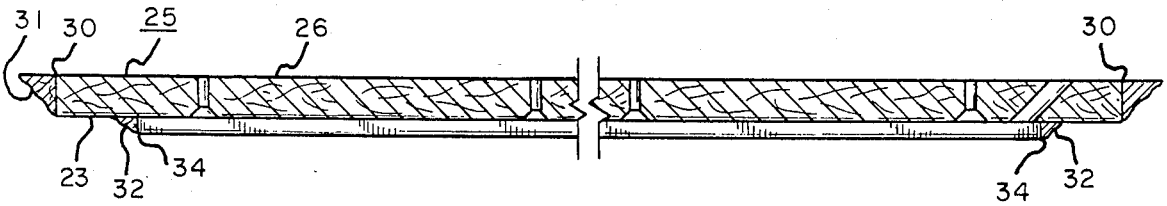
Fig. 6
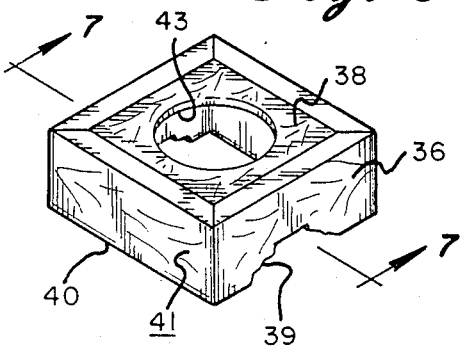
Fig. 7
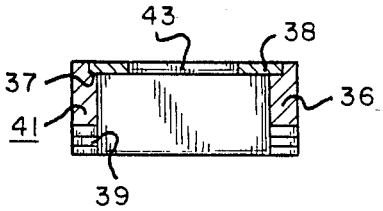

DECORATIVE LIGHTING TRACK SYSTEM

BACKGROUND OF INVENTION

The present invention applies to the art of transversely adjustable lighting track and associated track clamps and lighting fixtures and, more particularly, to a system for decoratively supporting and concealing such tracks and associated hardware.

Elongate standard transversely adjustable lighting tracks for use on ceilings and walls have been known for many years. These tracks typically include an elongate channel member having electrical conductors running along both sides or inturned edges of the track. A track clamp and electrical conduit is designed to fit within the track and be movable transversely along the track. The lighting clamp and its associated hardware provide the support for a lighting fixture and provide electrical current to the lighting fixture through wires passing through the lighting fixture and into the clamp and into electrical contact with the conductive strips positioned within the lighting track.

Lighting tracks and associated track clamps and lighting fixtures of this nature are commonly in use in homes and in commercial establishments and provide the flexibility of being able to move the lighting fixture along the track to center the light over such furnishings as desks, tables, and the like. The operation of such a system is simply to release the clamp, which may be of many different forms, move the clamp and associated lighting fixture along the track to the proper location and then reset the clamp to secure the clamp and associated lighting fixture in place and provide the necessary electrical contact.

Lighting fixtures of this nature are commonly secured in place simply by mounting the lighting track against the drywall of the ceiling or wall wherein the lighting fixture is to be secured. Such securement is commonly made by screwed passing through the track into the studs of a wall or ceiling joists as the case may be. Appropriate electrical wiring passes from the backside of the track in contact with the wall or ceiling through the sheetrock and into an appropriate junction box.

The clamp member may be secured into the elongate lighting track either by a threaded fastener gripping the clamp in place or by a releasable spring grips or fingers. Additionally, the clamp member may extend into a rigid connection with the lighting fixture or the lighting fixture may be suspended by means of the common and conventional chain and wire arrangement.

In any event, irrespective of the method of securement of the lighting fixture to the track clamp, the track clamp and the lighting track are always plainly in view. The lighting track and associated track clamps, while of different configurations, almost invariably are not of a decorative or particularly appealing configuration, being primarily functional in nature.

There does not exist today any system for a transversely adjustable lighting track, track clamp and lighting configuration wherein there is provided any means for concealing the lighting track and associated track clamp.

SUMMARY OF INVENTION

The present invention provides a track lighting system for decoratively supporting and concealing an elongate standard transversely adjustable lighting track and its associated track clamp and lighting fixture upon a surface such as a wall or a ceiling.

In accordance with the invention, a decorative flat panel member or planar member is provided which is first positioned flat upon the surface of the wall or ceiling upon which the lighting fixture is to be secured. Thereafter, the standard elongate lighting track is placed in position upon the other of the flat surfaces opposite the surface of the ceiling or wall and secured in place by means of conventional threaded fasteners and likewise wired into the electrical system through the panel member in a conventional manner.

Decorative crown molding is then positioned around the ends and sides of the panel or planar member to provide a finished look. Further decorative plank molding is positioned along the sides and ends of the lighting track to provide a finished and decorative look.

In accordance with the invention, a four sided box-like hollow track cover member is provided which includes four side walls and an end wall and is of a depth in excess of the depth of the lighting track. Two of the opposed side walls include cutouts therein of configuration complementary to the cross section of the lighting track and its associated plank molding.

The end wall of the cover member includes a cutout therein of dimension less than the standard bell on a conventional lighting member.

During installation, the cover member is positioned over the clamp member and the track clamp is positioned in place in the lighting track followed by securement of the lighting fixture to the track clamp. When all of the members are threaded or otherwise fixed into place, the bell of the lighting fixture will secure the track cover member in place against the under surface of the panel member or planar surface and maintain the same in place thus concealing the track clamp from view while, at the same time, permitting easy release and readjustment of the track clamp and associated lighting fixture.

Thus, in accordance with the present invention, the panel member, the crown molding and plank molding associated with the panel member and lighting track and the track cover member all provide a decorative finished appearance for the lighting track system while not impairing its practical ability to be adjusted in accordance with the desires to the user.

Other advantages of the present invention will become apparent to those skilled in the art from the detailed description thereof which follows.

DESCRIPTION OF DRAWINGS

FIG. 3 is a perspective view of the panel or planar member and its associated crown and plank molding in accordance with the present invention;

FIG. 4 is an end cross sectional view of the panel or planar member of the present invention along the lines 4—4 of FIG. 3;

FIG. 5 is an elongate cross sectional view of the panel or planar member of the present invention taken along the lines 5—5 of FIG. 3;

FIG. 6 is a perspective view of the track cover member of the present invention;

FIG. 7 is a cross sectional view of the track cover member of the present invention taken along the lines 7—7 of FIG. 6.

DETAILED DESCRIPTION OF INVENTION

Figure 8:
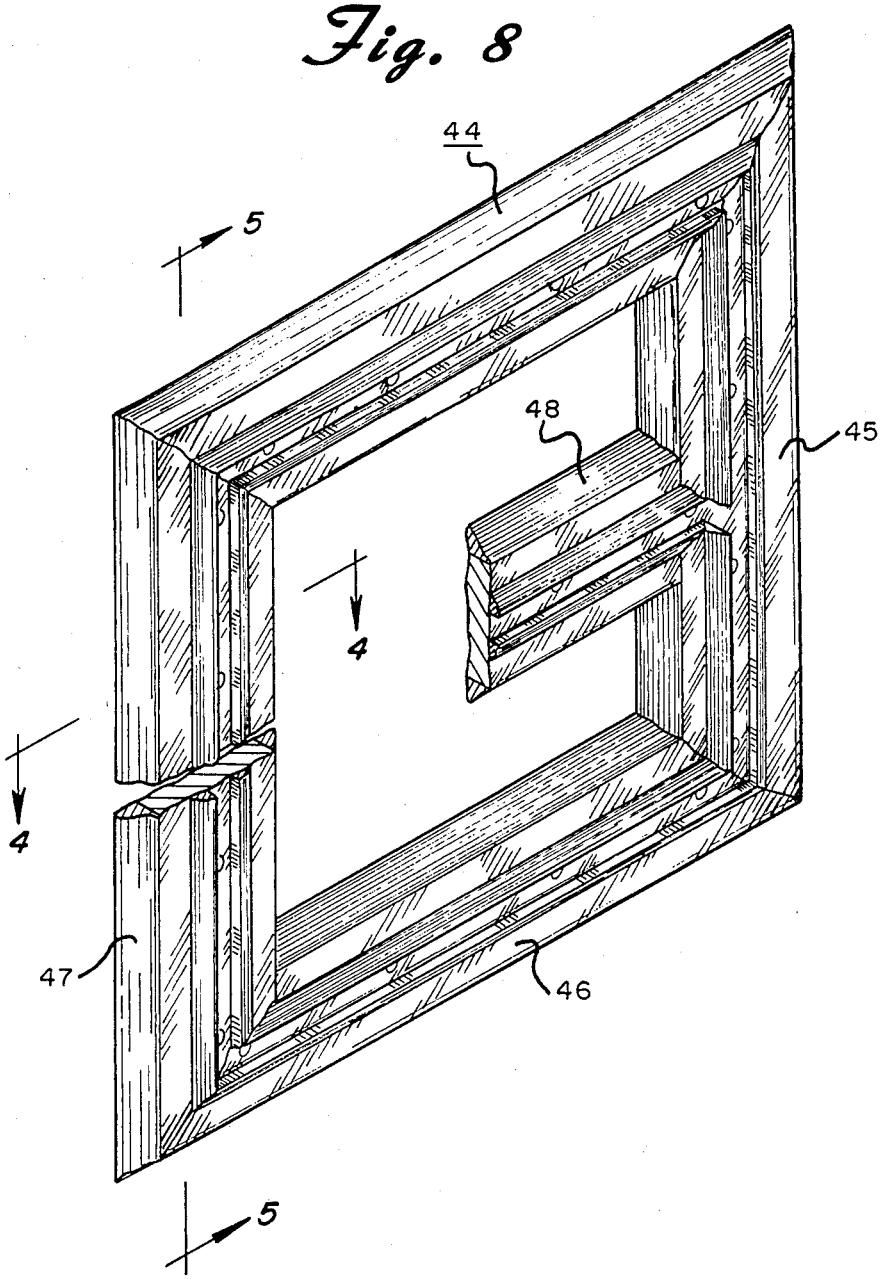
FIG. 8 is a perspective view of a composite of panel or planar members and associated molding of the present invention providing for multiple tracks and lighting fixtures.

A first embodiment of the track lighting system of the present invention is shown in FIGS. 1–7 of the drawings. A second embodiment of the track lighting system of the present invention formed of a composite of the single system shown in FIGS. 1–7 is shown in FIG. 8 of the drawings.

The basic track lighting system of the present invention will first be described in relation to FIGS. 1–7 of the drawings. The description which follows hereinafter will be taken generally in respect to all of FIGS. 1–7 and, where necessary, reference will be made to a specific figure as required.

Figure 2:
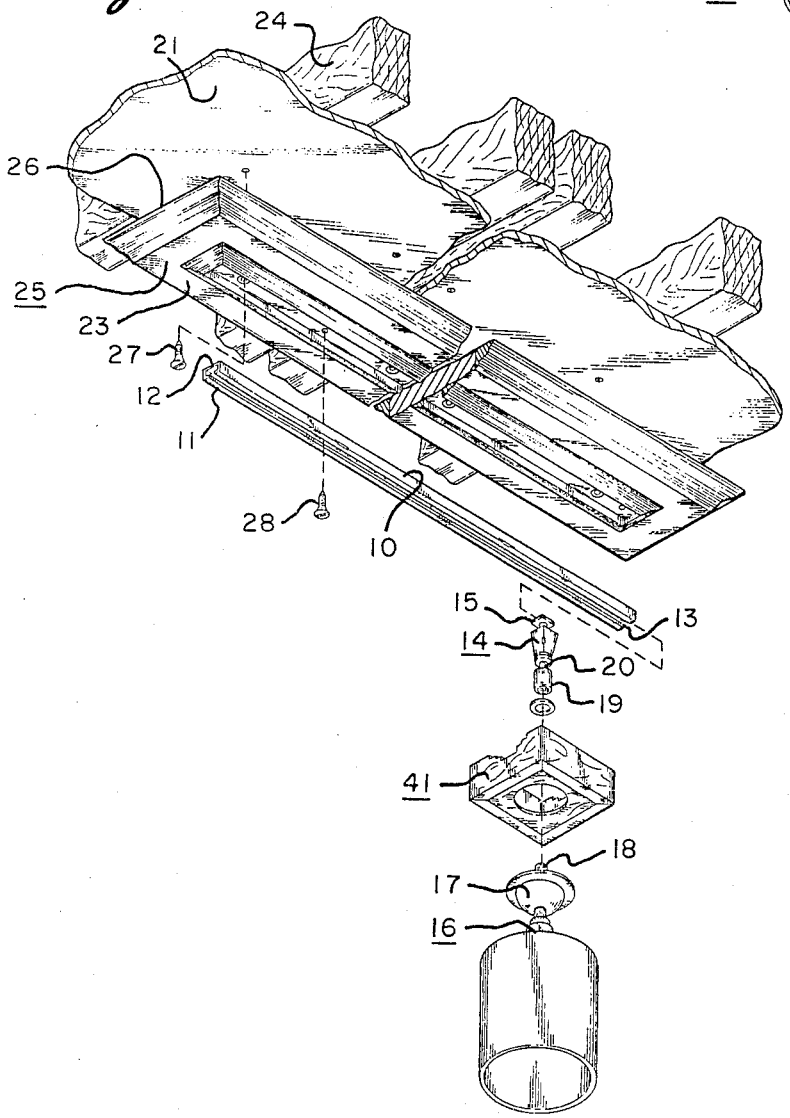
FIG. 2 is a perspective exploded view of the decorative track lighting system of the present invention.

The track lighting system of the present invention is utilized in conjunction with a standard adjustable lighting track and associated track clamp and lighting fixture as more specifically shown in FIG. 2. A standard elongate transversely adjustable lighting track 10 is utilized in the system. This type of lighting track is commercially available and generally is of the type which includes side walls 11 joined by a back wall 12. The side walls have inturned edges 13 which provide a track groove for a clamping member. Positioned within the inner surfaces of the side walls 11 or inturned edges 13 are opposed electrically conductive strips (not shown) which provide the electrical connection to a clamping member 14.

The track clamping member 14 is of a conventional nature and the details thereof are not felt necessary to be fully described. Basically, the track clamping member utilized a conductive tang 15 which is designed to fit within the groove of the lighting track and to come into contact with the electrical conductors therein.

A lighting fixture 16 is also a part of the conventionally and normally available system. The lighting fixture 16 has a threaded connection into a standard bell 17. Threaded fastening members 18, 19 and 20 cooperate with the track clamp in a manner such that, as the threaded members are engaged with one another, the tank 15 of the track clamp will be pulled into firm engagement with the lighting track to secure the track clamp in place and into electrical contact with the conductive strips therein all in a conventional and well-known manner.

Heretofore, the lighting track 10 had been placed directly against the ceiling sheetrock 21 or wall sheetrock 21 and secured in place thereon by conventional threaded fasteners passing through the lighting track and into the wall studs or ceiling joists 24 as the case may be.

In accordance with the present invention, the track lighting system provides a panel or planar member 25 which is of generally rectangular configuration of length and width in excess of the lighting track. The panel or planar member includes opposed flat surfaces 23 and 26 as best shown in FIG. 5 of the drawings.

In use, the panel or planar member 25 is placed in contact with the wall or ceiling surface with one of its opposed flat surfaces 26 in contact therewith. The panel or planar member is then held in place upon the wall or ceiling surface by means of conventional threaded fasteners 27 as best shown in FIG. 2 of the drawings.

The lighting track 10 is positioned upon the other opposed flat surface 23 of the panel member and secured in place by means of conventional threaded fasteners 28 as shown in FIG. 2 of the drawings. The lighting track may be positioned upon the panel or planar member 25 either prior to its being positioned upon the wall or ceiling or subsequent thereto as desired. In any event, the track member is most preferably centered lengthwise and widthwise upon the generally rectangular panel or planar member. Electrical wiring to the lighting track is accomplished in a conventional manner and it is not believed necessary to explain the details thereof.

In accordance with the present invention, the panel or planar member 25 includes around its side edges 29 and end edges 30, as shown in FIGS. 4 and 5, a crown molding 31 appropriately mitered at the corners. This crown molding may be secured in place by conventional means such as finishing nails or the like. The crown molding 31 may be secured in place either prior to the positioning and securing of the panel or planar member or thereafter although it is preferable that the same be constructed as a finished product prior to the installation of the panel member upon the surface of the wall or ceiling.

In a like manner, a plank molding 32 is positioned upon the other opposed flat surface 23 of the panel or planar member 25 and against the side edges 33 and end edges 34 of the lighting track as shown in FIGS. 4 and 5. The plank molding 32 may be placed upon the other flat surface 23 of the panel or planar member 25 either prior to the installation of the lighting track or subsequent thereto although it is preferred that the plank molding be placed in advance of placing of the track member to likewise provide a finished subassembly prior to the installation of the track lighting system. In such a case, commercially available track lighting may be purchased of sufficient length such that it may be cut off to fit the prepositioned plank molding 32.

Further in accordance with the present invention and as best shown in FIGS. 6 and 7 of the drawings, a decorative lighting track cover 41 is provided. The cover includes four opposed side walls 36. The side walls 36 are of a depth in excess of the height of the lighting track and its associated plank molding.

The track cover sides 36 have a recess 37 cut therein providing a supporting shelf for an end wall 38 as best shown in FIG. 7.

Figure 1:
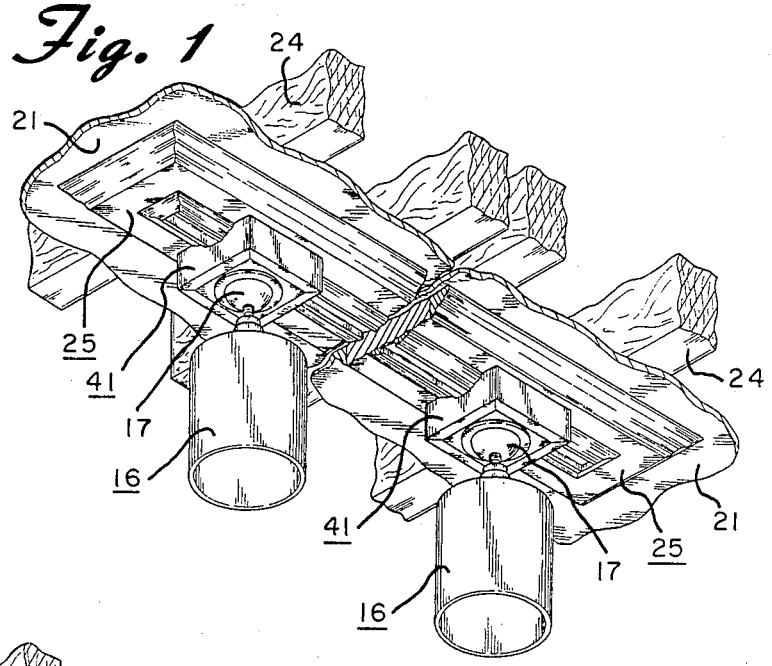
FIG. 1 is a perspective assembled view of the decorative track lighting system of the present invention.

Two of the opposed side walls 36 include a cutout 39 therein. The cutout 39 is of a configuration complementary with the cross section of the lighting track 10 and its associated plank molding 32. This arrangement permits the track cover to be positioned with the upper edges 40 of the sidew alls 36 in contact with the opposed flat surface 23 of the planar or panel member 25 when the cutout 39 is aligned with the lighting track 10 and plank molding 32 as best shown in FIG. 1 of the drawings.

The lighting track cover 41 includes within the end wall 38 thereof an aperture 43. The aperture 43 is of a dimension such that it will restrict passage of the bell 17 of the lighting fixture 16 through the aperture 43.

During assembly of the track lighting system of the present invention, the panel or planar member 25 and its associated crown molding 31, plank molding 32 and lighting track 10 will all have been secured in place upon the wall or ceiling surface upon which the lighting fixture is to be secured. Additionally, by this time the track clamp 14 will have been placed in position with its tang 15 within the groove of the lighting track 10 and releasably moved to the desired position.

Prior to the engagement of the track clamp 14 with the lighting track 10, the lighting track cover member 41 will have been moved downwardly over the track clamp 14 with the aperture 43 thereof into contact with the bell 17 of the lighting fixture 16. At this point, the threaded members 18, 19 and 20 will be turned to thread inwardly these members one to the other to take up the play bringing the bell 17 into engagement with the aperture 43 within the end wall 38 of the track cover member. As the threaded members are increasingly brought into engagement with one another, the edges 40 of the side walls 36 of the cover member 41 will come into engagement with the opposed flat surface 23 of the planar or panel member 25 until the entire assembly is brought firmly into secured position. At this point, the lamp assembly is in engagement with the lighting track cover which, in turn, is in engagement with the panel or planar member while the track clamp is held into firm engagement and electrical contact with the lighting track. Slight disengagement of the threaded engagement of the threaded members will permit the entire light assembly and track clamp to be moved to a new desired position along the lighting track.

A further variation or embodiment of the track lighting system of the present invention is shown in FIG. 8 of the drawings. In this embodiment, a plurality of assemblies, as shown in FIG. 3, may be arranged into differing configurations. In the particular case of FIG. 8, the arrangement is made into a rectangle having four sides 44–47 respectively and an interposed intermediate section 48. Each of the sections 44–48 are of an identical construction to the assembly shown in FIG. 3 except that they are appropriately mitered together at their points of intersection or juncture. The electrical connections for each of the sections may be connected electrically in parallel back to a common electrical source.

The embodiment of FIG. 8 provides a unique and novel arrangement whereby lights may be suspended over a larger area and in any particular given configuration as desired. Additionally, other arrangements and configurations other than that shown in FIG. 8 may be made of the basic component section as that shown in FIG. 3. The manner of attachment of the lighting track, track clamp and lighting fixture with the arrangement of FIG. 8 is identical to that as shown in the arrangement of FIGS. 1–7.

From the foregoing description of a track lighting system of the present invention, it will be appreciated that the track lighting system provides a unique and novel arrangement whereby standard conventional track lighting, track clamps and lighting fixtures may be suspended from a wall or a ceiling and maintain their versatility and adjustability along the lighting track while at the same time the system provides a decorative and eye appealing arrangement by concealing the lighting track and track clamp assembly.

The track lighting system of the present invention has been described in respect to the embodiments shown thereof in FIGS. 1–8 and as set forth in the preceding specification, it being understood that other variations and modifications thereof will now become apparent to those skilled in the art and accordingly, the scope of the invention is to be interpreted not in view of the particular embodiments disclosed and described but in view of the appended claims.

What is claimed is:

1. A track lighting system for decoratively supporting and concealing an elongate standard transversely adjustable lighting track and associated track clamp and lighting fixture upon a flat surface such as a common wall or ceiling comprising:

a decorative planar member having opposed flat surfaces and a predetermined perimetral configuration in excess of that of the lighting track and adapted to be secured upon the flat surface by one opposed flat surface and adapted to have secured upon the other opposed flat surface the lighting track; and a decorative lighting track cover member of configuration adapted to fit over a portion of the lighting track within the perimetral bounds of the decorative planar member and be interposed between the lighting track and track clamp when secured in place and the lighting fixture to conceal the lighting track and track clamp.

2. The track lighting system of claim 1 wherein the cover member includes side walls having opposed cutouts of configuration complementary to the cross section of the lighting track providing for a concealing fit over the lighting track and further including an end wall supported by the side walls and providing a concealing and supporting wall for the lamp fixture which, when in place, maintains the lighting track cover member secured against the planar member.

3. The lighting track system of claim 2 further including a decorative trim around the perimetral configuration of the planar member.

4. The track lighting system of claim 3 further including decorative trim around the lighting track and wherein the cutouts of the cover member are further complementary to the decorative trim.

* * * * *